US005458370A

United States Patent [19]

Melcher

[11] Patent Number: 5,458,370

[45] Date of Patent: Oct. 17, 1995

[54] TRIPLE SKI SYSTEM AND LINKAGE THEREFOR

[75] Inventor: Daniel J. Melcher, 1239 W. Esplanade St., Mesa, Ariz. 85201

[73] Assignee: Melcher; Daniel J., Mesa, Ariz.

[21] Appl. No.: 250,274

[22] Filed: May 27, 1994

[51] Int. Cl.[6] ..... A63C 5/00

[52] U.S. Cl. ..... 280/817; 280/14.2; 280/15; 441/73

[58] Field of Search ..... 280/601, 607, 280/609, 617, 618, 809, 817, 878, 14.2, 15, 16, 22, 22.1, 28.15; 441/68, 73, 72

[56] References Cited

U.S. PATENT DOCUMENTS 3,123,844 3/1964 Bailey ..... 441/72
3,540,750 11/1970 Berger ..... 280/16
3,666,281 5/1972 Billings ..... 280/15
3,841,649 10/1974 McMullen ..... 280/16
3,907,320 9/1975 Charneck ..... 280/818

*Primary Examiner*—Richard M. Camby
*Attorney, Agent, or Firm*—O'Connor, Cavanagh

[57] ABSTRACT

Ski apparatus two outer skis coupled to a third ski, located between the two outer skis, by four cranks, connected as a front pair and a rear pair. Each crank has a gear on one end and a free end. The free end of a crank is attached to a journal box on an outer ski to permit the crank to rotate freely. The gear of the crank from one outer ski meshes with the gear of a crank attached to the other outer ski, coupling the cranks in pairs and causing the cranks to rotate in opposite directions. The gears from each pair are contained in a gearbox attached to the third or middle ski. The cranks can be stiff or resilient and, if resilient, includes an elbow joint which is spring biased to force the middle ski below the outer skis.

15 Claims, 2 Drawing Sheets

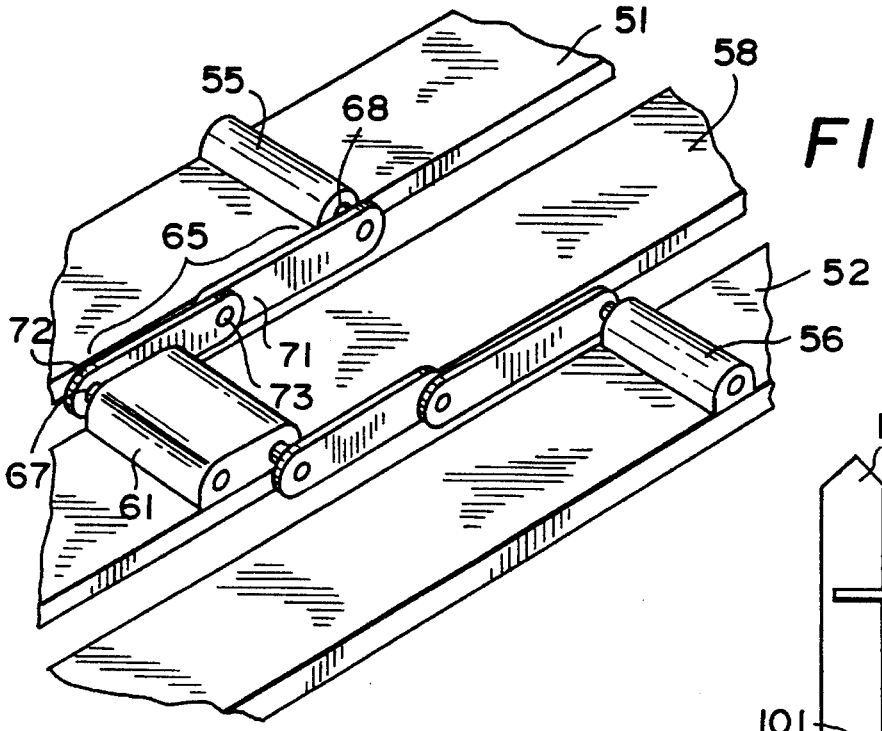
FIG. 5
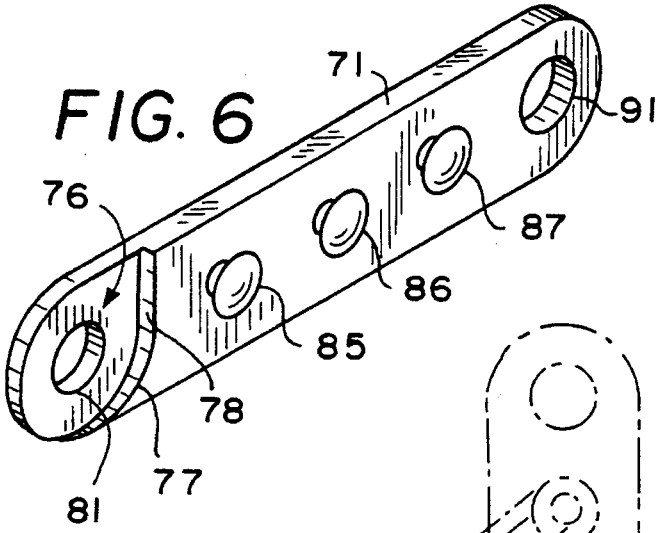
FIG. 6
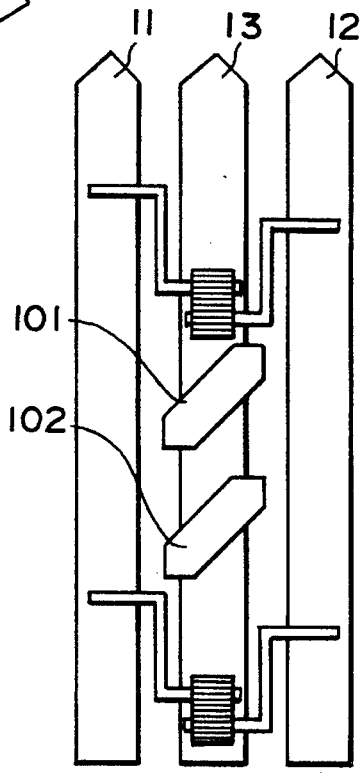
FIG. 8
FIG. 7
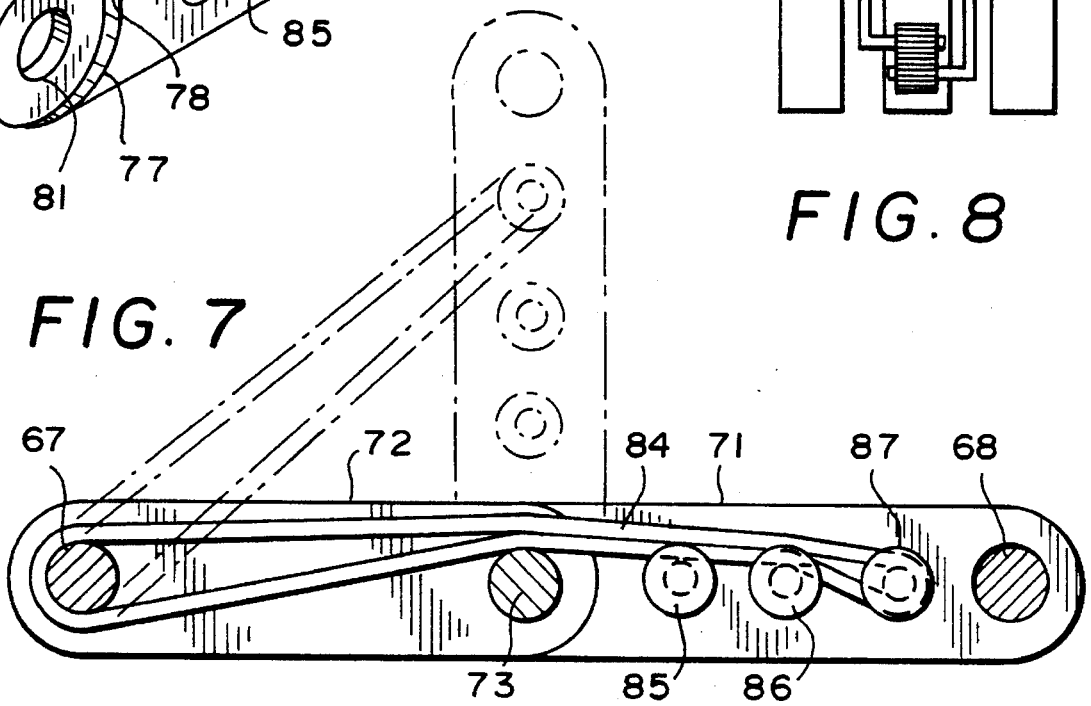

TRIPLE SKI SYSTEM AND LINKAGE THEREFOR

BACKGROUND OF THE INVENTION

This invention relates to a ski system incorporating linkage to cause skis to operate in coordinated fashion and, in particular, to a system having a linkage for interconnecting three skis.

Snow conditions can vary widely from place to place and even from day to day. It is more difficult and less enjoyable to ski when conditions are marginal, e.g. excessively deep "powder" or an icy crust on the snow. A typical ski is narrow and has a relatively low surface area for its length. Consequently, the ski applies a pressure greater than powdery snow can support and the ski sinks into the powder, slowing the skier. A problem with ice is that the edges of the skis provide some control on ice but the forces on the skis can exceed the breakaway force of an edge. If so, a skier can slide sideways, or worse.

This invention relates to high performance skis particularly suited to marginal conditions. By high performance is meant skis which permit a skier to move as quickly as possible, either in terms of speed or in terms of changing direction. Adding a third ski and coupling it to the other skis will increase the surface area in contact with the snow and add an edge for control on ice. However, a problem is thus created when adding the third ski to the others; that is, the ski must be added in such a way that performance in good snow conditions is not compromised.

The known prior art relating to interconnected or coupled skis is generally concerned with sleds. As used herein, skiing refers to a system wherein the skier's feet are mounted directly (by way of boots and bindings) to the skis and the skier's feet control the skis. Sleds are typically provided with two or more skis and utilize a steering/tilting mechanism for controlling the skis.

In most sleds, a central or main ski is balanced by two outrigger skis, one on each side of the main ski. In some cases, the skis are in a side-by-side or overlapping relation and in other cases the middle ski is forward of the outrigger skis and there is no overlap between the middle ski and the outrigger skis (the heel of the middle ski is ahead of the tips of the outrigger skis). The outrigger skis are either rigidly attached to the central ski, e.g. as disclosed in U.S. Pat. No. 3,666,281 (Billings), or are connected to the central ski by a complicated mechanism for tilting at least the outrigger skis as the rider leans from side to side, e.g. as disclosed in U.S. Pat. Nos. 3,540,750 (Berger) or 3,841,649 (McMullen).

These sleds are ridden, typically in a seated position, and do not give the same sensation, or permit the same freedom of movement, as skiing. Further, the tilting/steering mechanisms on the sleds are complicated and relatively heavy, i.e. weighing more than two or three skis.

A skier traversing a slope has one ski slightly higher than the other ski, enabling the skier to remain vertical and causing the trailing (uphill) edges of the skis to dig into the snow for directional control. Sleds of the prior art emulate this condition either by rotating each ski about the longitudinal axis of the ski or by lifting one ski relative to the other.

A ski is typically rotated by means of a parallelogram mechanism, e.g. as disclosed in the Berger patent. A ski is lifted by means of a complicated mechanism, such as disclosed in the McMullen patent, which converts rotary motion to linear motion and then back to rotary motion.

Either technique utilizes a mechanism which is too large, too heavy, and too complicated for skiing equipment. Of the two techniques, lifting one ski relative to the other is preferred since such permits a rider to remain vertical while traversing a slope or leaning into a turn.

A problem with either lifting or rotating a ski is that one assumes that the snow is fairly smooth. "Rough" as applied to terrain can have different meanings, depending upon the scale one uses to measure roughness. For skiing, one wants roughness on a large scale, i.e. hills or mountains. Some skiers prefer the challenge of moguls, small mounds having diameters of a couple of ski lengths or more. As used herein, rough means having bumps of a diameter less than one ski length and, particularly, of a diameter approximately equal to the distance separating the outer skis of a triple ski.

On rough terrain, sleds of the prior art can quickly transfer the combined weights of the rider and sled to just one or two skis. At best, a rough terrain can cause a bumpy ride; at worst, the rider can lose control or spill. Particularly in rough terrain, simply rotating or lifting a ski does not provide sufficient control over the position of the skis. It is desirable that the linkage between the skis have some resiliency to accommodate rough terrain. It is also desirable that triple skis respond to canting of one ski by having the middle ski assume an intermediate canted position between the canted ski and the third ski. These capabilities would improve the performance of triple skis in all terrains and snow conditions but are not obtainable from tilting/steering mechanisms of the prior art.

When used in conjunction with the skis alone, "vertical" and its cognates refer to the direction perpendicular to the plane of the skis. Canting means rotating a ski in a vertical plane; e.g. lifting just the tip of one ski.

A snowboard is a single board to which both of a skier's feet are mounted in a fore and aft configuration. Edge control is obtained by leaning from side to side and a snowboard is more difficult to learn to control than a pair of skis. A problem with a snowboard is that there is only a single edge for directional control and control is best obtained in powder. Since a snowboard is often used in marginal snow conditions, it is desired to improve the directional stability of a snowboard while retaining the other characteristics of a snowboard.

In view of the foregoing, it is therefore an object of the invention to provide linked triple skis for skiing.

A further object of the invention is to provide a mechanically simple linkage for interconnecting skis into a set of three skis for skiing in deep powder.

Another object of the invention is to provide high performance Alpine skis having three edges for better performance in all snow conditions, particularly icy conditions.

A further object of the invention is to provide a linkage using only rotary motion for controlling three interconnected skis.

Another object of the invention is to provide a linkage using only rotary motion for lifting one ski relative to another in a set of three skis.

A further object of the invention is to provide a linkage for interconnecting three skis and controlling lift and cant of the skis.

Another object of the invention is to provide a linkage for interconnecting three skis for skiing in rough terrain.

A further object of the invention is to provide a resilient linkage for interconnecting three skis.

Another object of the invention is to provide a linkage for interconnecting three skis in which canting one outer ski causes the middle ski to cant an intermediate amount.

A further object of the invention is to provide linked triple skis for sledding wherein the linkage is more compact, lighter, and enables more aggressive manoeuvres than sleds of the prior art.

Another object of the invention is to improve the directional stability of a snowboard.

SUMMARY OF THE INVENTION

The foregoing objects are achieved in the invention in which two outer skis are coupled to a third ski located between the two outer skis. There are four cranks, connected as a front pair and a rear pair. Each crank has a gear on one end and a free end. The free end of a crank is attached to a journal box on an outer ski to permit the crank to rotate freely. The gear of the crank from one outer ski meshes with the gear of a crank attached to the other outer ski, coupling the cranks in pairs and causing the cranks to rotate in opposite directions. The gears from each pair are contained in a gearbox attached to the third or middle ski. The linkage thus includes just two gear boxes, four journal boxes, and four cranks, all of which can be made very strong and light. In an alternative embodiment of the invention, the cranks are resilient, preferably including an elbow joint which is spring biased to force the middle ski below the outer skis.

The outer skis include bindings for a skier. The linkage holds the three skis in a predetermined alignment, preferably approximately co-planar and parallel, and permits the skis to be moved vertically relative to each other. If one outer ski is lifted relative to the middle ski, then the front and rear cranks attached to that ski rotate, causing the gears on each crank to rotate. Since the gears from each pair of cranks are meshed, lifting one outer ski causes the other outer ski to be forced downward relative to the middle ski, which is positioned vertically between the outer skis. The cranks in the front and rear pairs need not rotate the same amount, permitting the skis to be canted in a coordinated fashion, i.e. with the middle ski in a position intermediate the outer skis.

BRIEF DESCRIPTION OF THE DRAWINGS

A more complete understanding of the invention can be obtained by considering the following detailed description in conjunction with the accompanying drawings, in which:

FIG. 5 illustrates three skis coupled by a linkage constructed in accordance with an alternative embodiment of the invention;

FIG. 6 illustrates the construction of one arm of a hinge linkage constructed in accordance with the invention;

FIG. 7 illustrates a hinge linkage constructed in accordance with the invention; and FIG. 8 illustrates three skis configured as a snowboard.

DETAILED DESCRIPTION OF THE INVENTION

Figure 1:
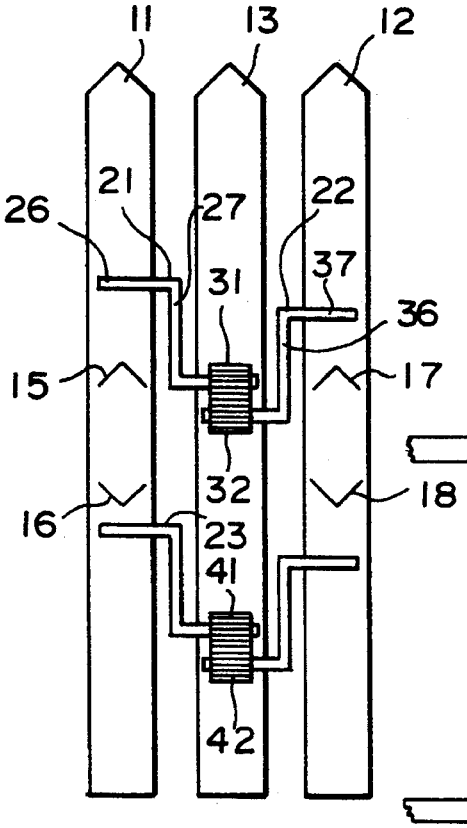
FIG. 1 schematically illustrates a linkage for coupling three skis in accordance with a preferred embodiment of the invention.

FIG. 1 illustrates three skis interconnected by linkage constructed in accordance with the invention. Specifically, skis 11 and 12 are connected to middle ski 13 by linkage which maintains the skis, when at rest, in an approximately co-planar, parallel position and permits vertical and pivotal movement of the skis relative to each other. A skier mounts skis 11 and 12 on bindings represented by chevrons 15, 16, 17, and 18.

Cranks 21, 22, 23, and 24 interconnect skis 11 and 12 with middle ski 13, which can have a different size and shape from skis 11 and 12. Cranks 21–24 are divided into pairs in which the front pair includes cranks 21 and 22 and the rear pair includes cranks 23 and 24. Crank 21 includes free end 26 overlying ski 11 and engaging a journal box (not shown) attached to ski 11. Crank 21 includes offset 27 connecting free end 26 to shaft 28. Gear 31 is attached to shaft 28 and meshes with gear 32. Gears 31 and 32 are contained in a gear box (not shown) attached to ski 13. Gear 32 is mounted on shaft 35 which is connected by offset 36 to free end 37. Free end 37 overlies ski 12 and engages a journal box (not shown) attached to ski 12. Cranks 23 and 24 and gears 41 and 42 are similarly attached to skis 11–13.

In a preferred embodiment of the invention, free end 26 is orthogonal to offset 27, offset 27 is orthogonal to shaft 28, and shaft 28 is parallel to free end 26. Cranks 22–24 are similarly constructed. As such, skis 11–13 are held parallel with each other and separated by a predetermined distance. If ski 11 is raised vertically, gear 31 rotates downwardly, causing gear 32 to rotate upwardly, as illustrated in FIG. 1. As gear 32 rotates upwardly, crank 22 moves ski 12 vertically downward.

As illustrated in FIG. 1, cranks 21–24 include right angles between the different portions thereof. If angles other than right angles are used, the skis can become splayed or stemmed as they move vertically. Gears 31, 32, 41, and 42 are preferably spur gears mounted on parallel axes. If the cranks include an angle other than a right angle, then the axes of the shafts intersect and bevel gears may be necessary for the gears to mesh properly. The embodiment illustrated in FIG. 1 is preferred for its low cost and simplicity.

As skis 11 and 12 move vertically relative to ski 13, ski 13 moves slightly ahead of skis 11 and 12. The tips of skis 11 and 12 remain even, i.e. the tips lie along a line perpendicular to the lengths of the skis. Because of the forward or rearward motion by ski 13, the skier feels only a vertical or linear motion in skis 11 and 12, even though the motion is rotary. This is an important advantage of the invention because the feel transmitted to the skier is familiar and natural.

Figure 2:
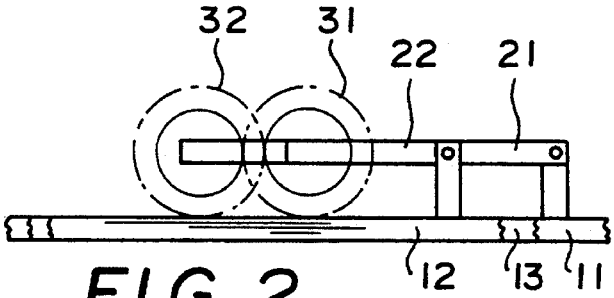
FIG. 2 illustrates the position of one pair of cranks when the skis are co-planar.
Figure 3:
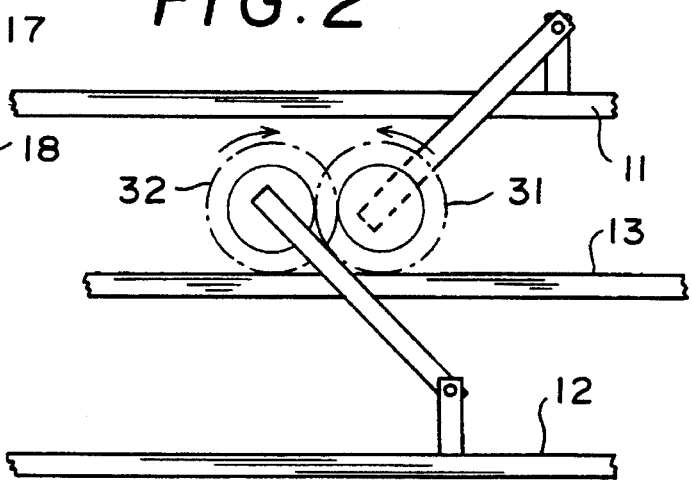
FIG. 3 illustrates the position of the skis when the cranks are rotated 45°.
Figure 4:
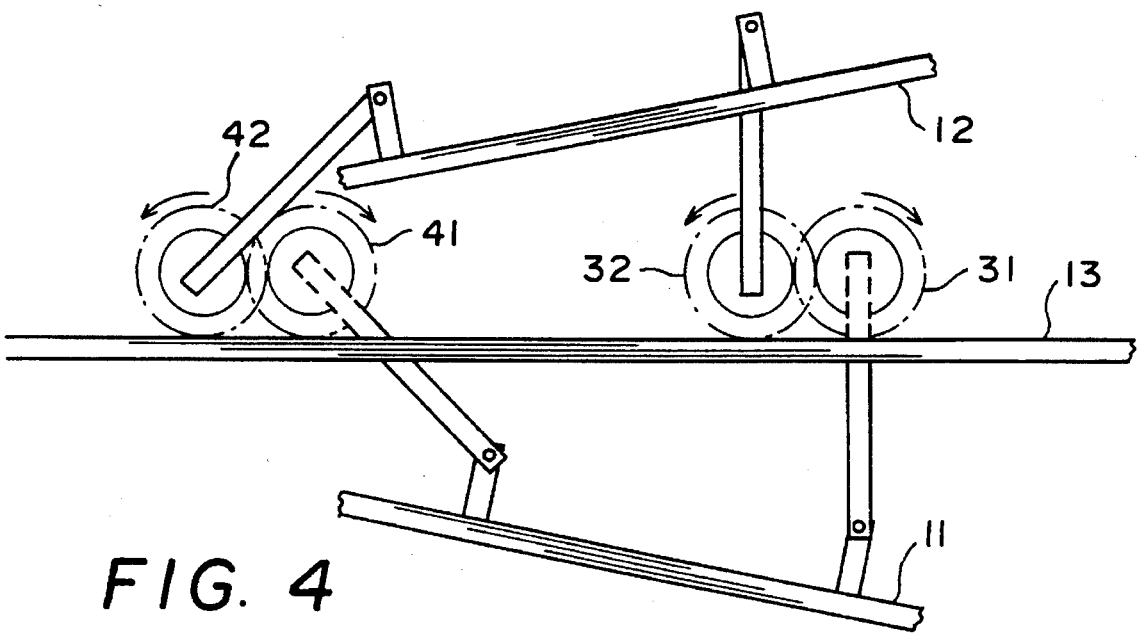
FIG. 4 illustrates canting the skis.

The relative motion of the skis is illustrated in FIGS. 2–4. FIG. 2 illustrates the initial condition of the skis. In this initial condition, skis 11–13 are co-planar, as are cranks 21 and 22. The cranks can be rotated slightly such that, as an initial condition, skis 11 and 12 are slightly above or below ski 13. A non-coplanar configuration is particularly useful for resilient cranks, described herein. In conjunction with FIGS. 2–4, it is assumed that the cranks are rigid. Whether or not the skis are co-planar, the offsets of the cranks extend in approximately the same direction.

FIG. 3 illustrates the motion of the skis when ski 11 is lifted vertically relative to middle ski 13. When ski 11 is lifted, gear 31 rotates counterclockwise. Gear 32 therefore rotates clockwise, lowering ski 12 relative to ski 13. Only one set of gears is shown in FIG. 3 because the longitudinal axes of the skis remain parallel. It is an advantage of the invention that the longitudinal axes of skis 11–13 need not be parallel as the skis are moved vertically.

In FIG. 4, ski 11 is canted downwardly with respect to ski 13 and ski 12 is canted upwardly with respect to ski 13. Skis 11 and 12 are controlled by the feet and legs of the skier. Ski 11 is lowered, rotating gear 31 approximately 90° clockwise and rotating gear 32 approximately 90° counterclockwise from the initial position. Gear 41 is rotated clockwise approximately 45° and gear 42 is rotated counterclockwise approximately 45°. The result is that the tip of ski 12 is raised more than the heel of ski 12 and the tip of ski 11 is lowered more than the heel of ski 11. Because of the coupling by the gears, ski 11 is lowered approximately the same amount that ski 12 is raised and ski 13 is positioned approximately half-way between skis 11 and 12.

FIG. 5 illustrates a linkage constructed in accordance with an alternative embodiment of the invention in which resilient cranks include elbow joints which are spring biased for lowering the middle ski relative to the outer skis. Left ski 51 is attached to journal box 55 and right ski 52 is attached to journal box 56. Gear box 61 is attached to middle ski 58. Crank 65 connects journal box 55 to gear box 61 and includes shaft 67 and free end 68. The offset between shaft 67 and free end 68 includes hinged arms 71 and 72 interconnected by pivot pin 73.

The construction of crank 65 is shown in more detail in FIGS. 6 and 7. In FIG. 6, arm 71 includes an elongated body of suitable flat stock having a portion of the end removed to form recess 76 having curved wall 77 and straight wall 78. Arm 72 is identical to arm 71 and, in FIG. 5, is flipped end for end from the illustration of arm 71 in FIG. 6. End portion 76 includes hole 81 for receiving pivot pin 73 (FIG. 5) and hole 91 is located adjacent the other end of arm 71 for receiving free end 68 (FIG. 5). Arm 72 is attached to arm 71 such that the recesses face each other and the holes in each arm are aligned. Straight wall 77 rests against the upper surface of arm 72 when the crank is flexed, as shown in FIG. 7, providing a limit or stop for the rotation of the arms. The corresponding straight wall on arm 72 rests on the upper surface of arm 71, also stopping the rotation of the arms.

Arm 71 includes posts 85, 86, and 87 along its length for receiving spring 84. Arms 71 and 72 are biased toward each other about pin 73 by spring 84, which is preferably an elastic band extending from free end 68 to shaft 67. If desired, to reduce the amount of bias, spring 75 can be attached to one of the posts. As illustrated in FIG. 7, spring 84 is connected between shaft 67 and post 87.

Spring 75 biases hinged arms 71 and 72 into a bent position in which arms 71 and 72 are at approximately a right angle, putting free end 68 above shaft 67. When all of the cranks are in this position, middle ski 58 is positioned below left ski 51 and is resiliently connected to ski 51. The right hand ski is similarly connected and is co-planar with the left hand ski and above middle ski 58.

When a skier mounts the skis, the weight of the skier forces the elbows open and the three skis are approximately co-planar, assuming the surface of the snow is relatively flat. The middle ski is resiliently coupled to the outer skis, enabling the triple ski to maintain better contact with the snow in rough terrain. As with the embodiment of FIG. 1, the initial position of the middle ski is adjustable by rotating the cranks prior to attaching the outer skis. For example, with the elbows open (the offsets are straight), the middle ski can be located slightly below the outer skis. This permits the triple ski to negotiate both bumps and depressions in rough terrain and keep all three skis in better contact with the snow.

While illustrated in a preferred embodiment with skis, the linkage of the invention can be used for other applications, e.g. snowmobiles and snowboards. FIG. 8 illustrates an alternative embodiment of the invention in which bindings 101 and 102 are attached to center ski 13 to provide the characteristics of snowboarding in a system in which skis 11, 12, and 13 have a total area approximately equal to the area of a snowboard. A particular advantage of the system illustrated in FIG. 8 is the three edges it provides for cutting the snow, as opposed to the single edge of a conventional snowboard. The feel of a snowboard is retained since steering is accomplished by leaning but the additional two edges provide greater directional control, particularly in crusty snow conditions.

The gear boxes and journal boxes are preferably made from thermoplastic. The cranks are preferably made from steel bar and suitably splined or flatted to engage the gears. The gears can be steel, plastic, or brass, e.g. depending on the width of the gear (if a plastic gear has a width of an inch or so, the strain on the teeth of the gear is not excessive). The choice of materials is a matter of design for those of skill in the manufacture of ski equipment. C-clips or other mechanisms for holding the free ends in the journals, bearings, seals, lubricants, and other construction details are also a matter of design. The skis are preferably of the same width and the cranks are preferably the same size, although the offsets of the rear cranks can be slightly longer than the offsets of the front cranks. While the overall length of the offsets depends upon skill and terrain, a length equal to the width of a ski is a good starting point.

The invention thus provides triple skis for skiing in which a mechanically simple linkage interconnects three skis and uses only rotary motion for controlling the skis. The linkage uses few components, does not greatly increase the weight of the skis, and does not degrade performance in good snow conditions. The skis can be lifted or canted for aggressive skiing in all snow conditions. The middle ski adds surface area and a third edge for skiing in marginal snow conditions and can be resiliently connected to the outer skis for skiing on rough terrain.

The invention can be used to improve the performance of sleds since the simplified linkage permits a steering/tilting mechanism to be attached to only one outer ski, thereby simplifying the mechanism. A sled having a linkage constructed in accordance with the invention would be lighter and more maneuverable than a sled having prior art linkage.

Having thus described the invention, it will be apparent to those of skill in the art that various modifications can be made within the scope of the invention. For example, the shafts in each pair of cranks can be made collinear by using planetary gears in the gear boxes, although planetary gears are more expensive than the preferred gears. Resiliency can be obtained by using a crank of spring steel and relying on torsion of one or both shafts in each pair for resiliency. Each crank can be a single bar bent as shown or made from two or three separate pieces, e.g. separate shaft, offset, and free end. Canting can be prevented by connecting the gear boxes by chain, toothed belt, or intermediate gears. As described above, the cranks can have other than 90° bends, enabling splaying or stemming of the skis when the skis are moved vertically. More than one spring can be attached to posts 85–87 and the elbow joint can be constructed to bend more or less than 90°. The spring can be attached to one side of the offset or can cross over to the other side of the offset, e.g. to connect a pin in one arm to a pin in the other arm. As illustrated in FIG. 8, bindings 101 and 102 are for left foot forward. The bindings can be rotated counter-clockwise 90° for right foot forward if desired. It may be desirable to build up or elevate bindings 101 and 102 from the upper surface of center ski 13 to accomodate the overhang of the bindings and prevent dragging the heel or toe of a binding in the snow when cornering or to prevent interference with skis 11 and

12 if the bindings overlap adjacent skis.

What is claimed is:

1. A linkage for connecting a third ski between a first ski and a second ski and permitting vertical relative movement among the skis, said linkage comprising:

a first crank and a second crank, wherein said first crank and said second crank each includes
a free end;
an offset;
a shaft; and
a gear attached to said shaft;

a first journal box for attachment to said first ski and receiving the free end of said first crank;

a first gear box for attachment to said third ski and enclosing the gears attached to said first crank and said second crank, wherein said gears mesh causing said first crank and said second crank to rotate in opposite directions; and a second journal box for attachment to said second ski and receiving the free end of said second crank.

2. The linkage as set forth in claim 1 wherein each offset is resilient.

3. The linkage as set forth in claim 2 wherein each offset includes a first hinge arm, a second hinge arm, a pivot connecting said first hinge arm to said second hinge arm, and a spring for biasing said first hinge arm toward said second hinge arm about said pivot.

4. The linkage as set forth in claim 1 wherein the offset of said first crank and the offset of said second crank extend in approximately the same direction.

5. The linkage as set forth in claim 1 wherein, in each crank, the free end is orthogonal to the offset, the offset is orthogonal to the shaft, and the shaft is parallel to the free end.

6. The linkage as set forth in claim 1 and further comprising:

a third crank and a fourth crank, wherein said third crank and said fourth crank each includes
a free end;
an offset;
a shaft; and
a gear attached to said shaft;

a third journal box for attachment to said first ski and receiving the free end of said third crank;

a second gear box for attachment to said third ski and enclosing the gears attached to said third crank and said fourth crank, wherein said gears mesh causing said third crank and said fourth crank to rotate in opposite directions; and a fourth journal box for attachment to said second ski and receiving the free end of said fourth crank.

7. The linkage as set forth in claim 6 wherein, in each crank, the free end is orthogonal to the offset, the offset is orthogonal to the shaft, and the shaft is parallel to the free end.

8. The linkage as set forth in claim 6 wherein the offset of said first crank, the offset of said second crank, the offset of said third crank, and the offset of said fourth crank all extend in approximately the same direction.

9. A ski set including a first ski, a second ski, and a third ski connected between said first ski and said second ski by linkage permitting vertical relative movement among the skis, wherein said linkage comprises:

four cranks connected in pairs to said skis as a front pair and a rear pair, wherein
each crank includes a gear on a first end and a free end;
the gears from each pair mesh and are attached to said third ski and the free ends of each pair of cranks are attached one each to the first ski and the second ski.

10. The ski set as set forth in claim 9 wherein said cranks are resilient.

11. The ski set as set forth in claim 10 wherein each offset includes a first hinge arm, a second hinge arm, a pivot connecting said first hinge arm to said second hinge arm, and a spring for biasing said first hinge arm toward said second hinge arm about said pivot.

12. Ski apparatus including a first ski, a second ski, and a third ski connected between said first ski and said second ski by linkage permitting vertical relative movement among the skis, wherein said linkage comprises:

a first crank and a second crank, wherein said first crank and said second crank each includes
a free end;
an offset;
a shaft; and
a gear attached to said shaft;

a first journal box attached to said first ski and receiving the free end of said first crank;

a first gear box attached to said third ski and enclosing the gears attached to said first crank and said second crank, wherein said gears mesh causing said first crank and said second crank to rotate in opposite directions; and a second journal box attached to said second ski and receiving the free end of said second crank.

13. The linkage as set forth in claim 12 wherein each offset is resilient.

14. The linkage as set forth in claim 12 wherein each offset includes a first hinge arm, a second hinge arm, a pivot connecting said first hinge arm to said second hinge arm, and a spring for biasing said first hinge arm toward said second hinge arm about said pivot.

15. The linkage as set forth in claim 12 wherein, in each crank, the free end is orthogonal to the offset, the offset is orthogonal to the shaft, and the shaft is parallel to the free end.

* * * * *